US007523927B2

(12) United States Patent
Stansch

(10) Patent No.: US 7,523,927 B2
(45) Date of Patent: Apr. 28, 2009

(54) DELIVERER MODULE FOR A PRESS WITH A DISPLACED PADDLE WHEEL FOR VARIOUS SIZED MEDIA

(75) Inventor: Karsten Stansch, Plauen (DE)

(73) Assignee: MAN Roland Druchmaschinen AG, Offenbach am Main (DE)

( * ) Notice: Subject to any disclaimer, the term of this patent is extended or adjusted under 35 U.S.C. 154(b) by 355 days.

(21) Appl. No.: 11/154,912

(22) Filed: Jun. 16, 2005

(65) Prior Publication Data

US 2005/0280201 A1 Dec. 22, 2005

(30) Foreign Application Priority Data

Jun. 16, 2004 (DE) ..... 10 2004 029 170

(51) Int. Cl.
*B65H 29/22* (2006.01)

(52) U.S. Cl. ..... 271/81; 271/315; 271/187

(58) Field of Classification Search ..... 271/315, 271/81, 187; 270/52.12; 101/227, 232, 480
See application file for complete search history.

(56) References Cited

U.S. PATENT DOCUMENTS

| | | | | | |
|---|---|---|---|---|---|
| 1,972,460 | A | * | 9/1934 | Quick et al. | 271/315 |
| 4,034,845 | A | * | 7/1977 | Honegger | 198/418 |
| 4,120,491 | A | * | 10/1978 | Lang | 271/303 |
| 4,461,212 | A | * | 7/1984 | Geney | 101/407.1 |
| 4,537,390 | A | * | 8/1985 | Kiamco et al. | 270/58.29 |
| 4,552,351 | A | * | 11/1985 | Tsukamoto | 271/315 |
| 4,940,223 | A | * | 7/1990 | Weigel et al. | 271/181 |
| 5,065,997 | A | * | 11/1991 | Butts et al. | 271/187 |
| 5,123,638 | A | * | 6/1992 | Mutou | 271/187 |
| 5,131,646 | A | * | 7/1992 | Balow | 271/187 |
| 5,156,389 | A | * | 10/1992 | Novick | 271/187 |
| 5,322,270 | A | * | 6/1994 | Belanger et al. | 271/187 |
| 5,501,127 | A | * | 3/1996 | Stauber | 83/100 |
| 5,647,586 | A | * | 7/1997 | Novick et al. | 271/182 |
| 5,803,705 | A | * | 9/1998 | Keyes | 414/793.9 |
| 6,131,904 | A | * | 10/2000 | Tomczak | 271/315 |
| 6,139,009 | A | * | 10/2000 | Eckert | 271/187 |
| 6,302,393 | B1 | * | 10/2001 | Beskitt et al. | 271/258.01 |
| 6,394,450 | B2 | * | 5/2002 | Kishine et al. | 271/315 |
| 6,443,062 | B2 | | 9/2002 | Ziegler et al. | |
| 6,464,218 | B2 | * | 10/2002 | Neary et al. | 271/270 |
| 6,755,128 | B2 | * | 6/2004 | Pane | 101/228 |
| 6,832,886 | B2 | * | 12/2004 | Michler et al. | 414/790.8 |
| 2005/0242498 | A1 | * | 11/2005 | Sato | 271/302 |

FOREIGN PATENT DOCUMENTS

| | | | | |
|---|---|---|---|---|
| GB | 2006 168 | A | | 5/1979 |
| JP | 60056768 | A | * | 4/1985 |
| JP | 02295849 | A | * | 12/1990 |
| JP | 05208769 | A | * | 8/1993 |

* cited by examiner

*Primary Examiner*—Patrick H Mackey
*Assistant Examiner*—Gerald W McClain
(74) *Attorney, Agent, or Firm*—Cohen Pontani Lieberman & Pavane LLP

(57) ABSTRACT

A deliverer module for a folder of a press includes a paddle wheel which receives products from the folder and subsequently deposits the products on a deliverer belt. At least the paddle wheel is displaceable in the horizontal and/or vertical direction relative to the folder.

4 Claims, 2 Drawing Sheets

DELIVERER MODULE FOR A PRESS WITH A DISPLACED PADDLE WHEEL FOR VARIOUS SIZED MEDIA

BACKGROUND OF THE INVENTION

1. Field of the Invention

The invention relates to a deliverer module for a folder of a press, the deliverer module having a paddle wheel receiving products from a folder and delivering the products to a delivery belt.

2. Description of the Related Art

U.S. Pat. No. 6,443,062 discloses a paddle wheel deliverer for a web-fed rotary press in which a paddle wheel of the paddle wheel deliverer receives products from a folder for subsequent deposition on a deliverer belt. According to U.S. Pat. No. 6,443,062, the paddle wheel of the paddle wheel deliverer is driven by its own controlled-position drive for controlling or regulating the rotational angle position of the paddle wheel in relation to the incoming products via a control system for the motor. The controlled position drive allows the paddle wheel to be displaced to a certain extent to increase the delivery quality of products transferred from the folder to the paddle wheel deliverer. However, the possible adjustments or possible displacements of the paddle wheel deliverer according to U.S. Pat. No. 6,443,062 are limited for adapting the paddle wheel deliverer to product changes.

SUMMARY OF THE INVENTION

An object of the present invention is to provide a novel type of deliverer module for a folder of a press that is adaptable for product changes.

The object is met by a deliverer module in which at least the paddle wheel is displaceable in the horizontal and/or vertical direction relative to the folder.

In the horizontal direction, at least the paddle wheel may be displaced relative to the folder such that the products are always transferred centrally or symmetrically to the paddles of the paddle wheel, irrespective of the product width.

By means of displacing at least the paddle wheel in the vertical and, if appropriate, the horizontal direction relative to the folder, it is possible to ensure that the products are transferred to the paddles of the paddle wheel in an accurate position, irrespective of the product thickness. In this way, the delivery quality can be improved considerably as compared with the prior art.

Preferred developments of the invention emerge from the following description. An exemplary embodiment of the invention will be explained in more detail by using the drawing, without being restricted thereto.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like references denote similar elements throughout the several views.

DETAILED DESCRIPTION OF THE PRESENTLY PREFERRED EMBODIMENTS

Figure 1:
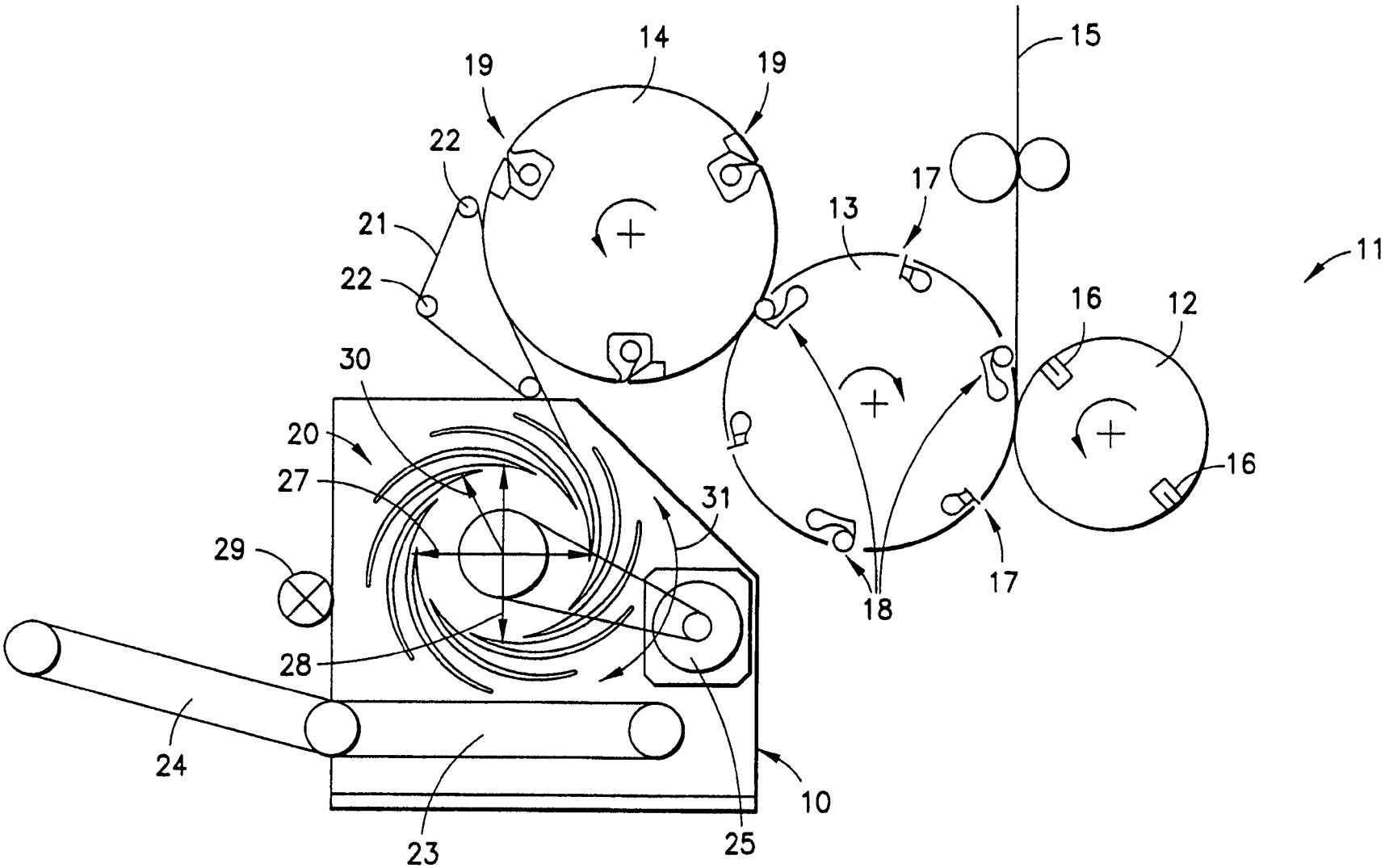
FIG. 1 is a schematic side view of a deliverer module according to the present invention with a folder of a press.

FIG. 1 shows a deliverer module 10 according to the present invention together with a folder 11 of a web-fed press. The folder 11 has a cutting blade cylinder 12, a folding blade cylinder 13 and a folding jaw cylinder 14. The cutting blade cylinder 12 and the folding jaw cylinder 14 rotate in the same direction and in the opposite direction to the folding blade cylinder 13. A printing material 15 is moved and guided between cutting blade cylinder 12, folding blade cylinder 13 and folding jaw cylinder 14. The cutting blade cylinder 12 comprises two cutting blades 16. With the aid of the cutting blades 16, copies are divided off from the printing material 15. The folding blade cylinder 13 comprises three folding blades 17 and three pinning devices 18. The three folding blades 17 are distributed uniformly about the circumference of the folding blade cylinder 13, in each case spaced apart from one another at an angle of 120°. The three pinning devices 18 are likewise distributed uniformly on the circumference of the folding blade cylinder 13, in each case spaced apart from one another at an angle of 120°. Each pinning device 18 is arranged between two folding blades 17. The folding jaw cylinder 14 preferably has three folding jaws 19, which are also distributed uniformly on the circumference of the folding jaw cylinder 14, spaced apart from one another at 120°.

To provide a fold on a copy divided off from the printing material 15, the cutting blade cylinder 12, the folding blade cylinder 13 and the folding jaw cylinder 14 interact such that, as a copy is divided off from the printing material 15 with the aid of a cutting blade 16 of the cutting blade cylinder 12, the copy divided off is held by a pinning device 18 at the start of the sheet and is moved onwards with the rotation of the folding blade cylinder 13. In this way, the copy divided off is moved into a relative position, defined for the folder, between folding blade cylinder 13 and folding jaw cylinder 14. When this relative position is reached, a folding blade 17 of the folding blade cylinder 13 forces the copy into the folding region between the open folding jaws 19 of the folding jaw cylinder 14, and the pinning device 18 releases the copy. The copy held in this way by the folding jaw cylinder 14 is then moved onwards with the rotation of the folding jaw cylinder 14 and, at a suitable position, is transferred from the folding jaw cylinder 14 to the deliverer module 10 according to the present invention.

The deliverer module 10, according to FIG. 1, has a paddle wheel 20 having a plurality of paddles, adjacent paddles of the paddle wheel 20 bounding paddle pockets. As already mentioned above, copies or products held in the folding jaw cylinder 14 are transferred from the folding jaw cylinder 14 to the deliverer module 10, use being made for this purpose of conveyor belts 21 which are guided on deflection rolls 22. The folded copies or products are accordingly released by the folding jaw 19 of the folding jaw cylinder 14 in the region of the conveyor belts 21, transferred to the conveyor belts 21, and introduced into paddle pockets of the paddle wheel 20 by the conveyor belts 21.

In addition to the paddle wheel 20, the deliverer module 10 also includes a deliverer belt 23, the paddle wheel 20 depositing the folded copies or products on the deliverer belt 23. A further transport belt 24 can follow the deliverer belt 23. As can be gathered from FIG. 1, the paddle wheel 20 is assigned an individual drive 25, with the aid of which the paddle wheel 20 and, if appropriate, the deliverer belt 23 are driven. However, the deliverer belt 23 can also be assigned its own drive. In the exemplary embodiment shown, the deliverer module 10 according to the invention accordingly comprises the paddle wheel 20, the individual drive 25 assigned to the paddle wheel 20 and the deliverer belt 23.

At least the paddle wheel 20 is designed such that it can be displaced in the horizontal and/or vertical direction relative to the folder 11, specifically in relation to the folding jaw cylinder 14 of the folder 11. The entire deliverer module. 10 is preferably designed such that it can be displaced in the horizontal and/or vertical direction relative to the folding jaw cylinder 14. In this preferred case, the paddle wheel 20 is displaceable in the horizontal and/or vertical direction together with the individual drive 25, the deliverer belt 23 and stripping devices, not illustrated. Using a deliverer module 10 that can be displaced in this way, the deliverer module may be optimally adapted to changing products, in particular to changing product widths and changing product thicknesses.

Figure 2:
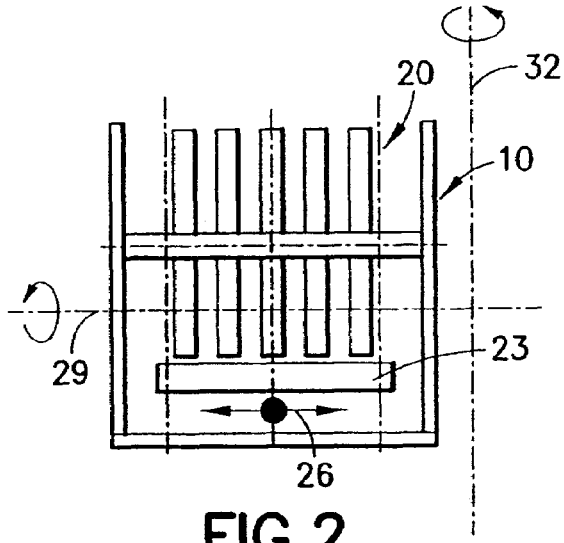
FIG. 2 is a front view of the deliverer module according to FIG. 1.

The deliverer module 10 can be displaced in the horizontal direction in the sense of the double arrow 26 of FIG. 2 in the horizontal direction relative to the folder 11, such that folded products or copies are always transferred centrally to the paddles of the paddle wheel 20, irrespective or their product width. By moving the entire deliverer module 10 horizontally in the direction of the double arrow 26, it is possible to ensure that the folded product is always guided symmetrically in the paddles of the paddle wheel 20 and on the deliverer belt 23.

In addition, in the preferred exemplary embodiment, the deliverer module 10 according to the invention may be displaced in the sense of the double arrows 27 and 28 shown in FIG. 1 in a further horizontal direction and in the vertical direction. This displacement in the direction of arrows 27 and 28 ensures that the folded products are transferred to the paddles of the paddle wheel 20 in an accurate position, irrespective of the product thickness. The displacement of the deliverer 10 in the direction of the double arrows 27 and 28 allows displacement of the deliverer module 10 in a direction parallel to the drop direction (arrow 30) of the folded product into the paddle pockets of the paddle wheel 20. This ensures a change in the drop time and in the drop angle of the folded products into the paddle pockets of the paddle wheel 20. Furthermore, in this way the distance of the folded product from a rear of the paddles of the paddle wheel 20 as the product is pushed into a paddle pocket may be adjusted.

Accordingly, the deliverer module 10 according to the present invention is distinguished by a large number of possible displacements to adapt the same to varying product thicknesses and product widths of a folded product. For this purpose, the deliverer module 10 can be moved as a unit in the horizontal and vertical direction and parallel to the drop direction of a folded product into the paddle wheel 20 of the deliverer module 10.

In the sense of the invention here, the deliverer module 10 is designed such that it can be displaced both during a machine run and during the machine stoppage.

Figure 3:
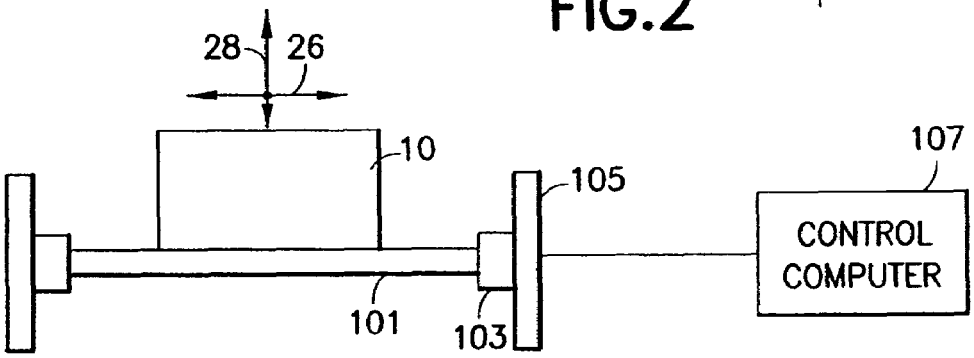
FIG. 3 is a schematic front view showing the deliverer module in a rail system.
Figure 4:
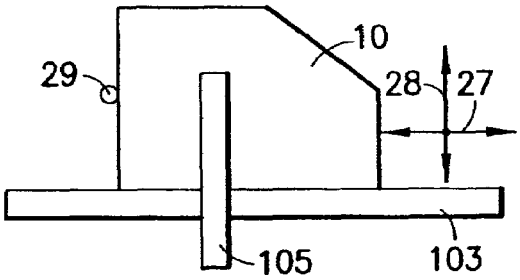
FIG. 4 is a schematic side view showing the deliverer module in the rail system.

The deliverer module 10 is mounted and guided in a rail system such that it can be displaced in the horizontal and/or vertical direction. FIG. 3 is a front view of the deliverer module 10 mounted on a cross rail 101. The deliverer module 10 is movably arranged on the cross rail 101 to move in the direction of double arrow 26. Referring also to FIG. 4, the cross rails 101 are arranged between rails 103 such that the deliverer module 10 and the cross rails 101 are movable along the rails 103 in the direction of double arrows 27. The assembly of rails 101, 103 and the deliverer module may be raised and lowered along double arrow 28 along a raise/lower rail 105. To ensure the ability to be displaced simply, the actual displacements may be effected using electric motor, pneumatic or hydraulic actuating devices. The displacement of the deliverer module 10 relative to the folder 11 to adapt the deliverer module 10 to varying product thicknesses and/or product widths may be carried out either in a fully automated manner or manually. It is also possible to store various positions or settings of the deliverer module 10 relative to the folder 11 in a control computer 107 for the deliverer module 10 as a function of predefined product widths and/or product thicknesses, in order to perform fully automatic displacement of the deliverer module 10 on the basis of these presettings.

Figure 5A:
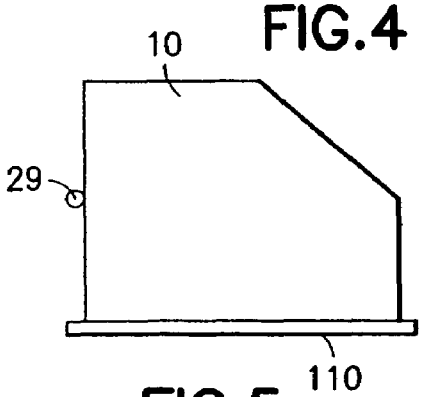
FIGS. 5*a*-5*b* are schematic views showing pivoting of the deliverer module.
Figure 5B:
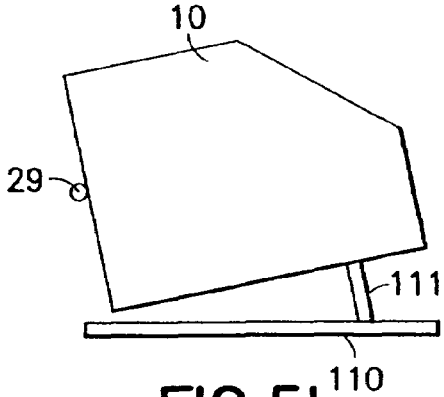

As indicated in FIGS. 1 and 2, the deliverer module 10 according to the invention can also be rotated or pivoted about an axis of rotation 29. This movement may be effected as shown in FIGS. 5*a*, 5*b*. The delivery module includes a base 110 on which the axis or rotation and a pivoting mechanism 111 are mounted. The pivoting mechanism may be actuated to pivot the deliverer module about the axis of rotation, e.g., between the positions shown in FIGS. 5*a*, 5*b*. If the deliverer module 10 is displaced in the horizontal direction in the sense of the double arrow 27, the position of the axis of rotation 29 also changes. For maintenance work, the deliverer module 10 can be removed completely from the folder 11 as a unit and displaced into an appropriate maintenance position. Pivoting about the axis of rotation 29 likewise effects a change in the drop time, drop angle in the pivoting direction 31 and in the drop position. In addition, it is also readily conceivable to pivot the deliverer module 10 laterally about another axis of rotation 32 (FIG. 2) for maintenance purposes.

It is also possible to keep the deliverer module according to the invention in its appropriate functional position by its being pressed pneumatically or hydraulically or in a spring-loaded manner against stops which can be displaced manually or under automatic control. The position of these stops is in turn influenced on the basis of the product, that is to say on the basis of the product thickness and/or product width of a folded copy.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A deliverer module in a press having a folder, wherein the deliverer module is arranged for receiving products from the folder, the module comprising:

a delivery belt:

a paddle wheel having a plurality of paddles and arranged for receiving the products from the folder, wherein said paddle wheel is arranged for depositing the products onto the delivery belt, and a drive for rotating said paddle wheel;

wherein the deliver module is entirely and linearly displaceable as a unit in a first horizontal direction and in a vertical direction relative to the folder.

2. The deliverer module of claim 1, wherein the deliver module is designed such that it can be linearly displaced in a second horizontal direction relative to the folder, wherein said second horizontal direction is orthogonal to said first horizontal direction.

3. The deliverer module of claim 2, wherein said deliverer module is pivotable about an axis extending in said second horizontal direction.

4. The deliverer module of claim 3, wherein a position of the axis changes by displacing the deliverer module in said first horizontal direction.

* * * * *